US005596854A

United States Patent [19]

Crigler

[11] Patent Number: 5,596,854

[45] Date of Patent: Jan. 28, 1997

[54] POST-TENSIONING ANCHOR HEAD ASSEMBLY

[75] Inventor: John R. Crigler, Morgan Hill, Calif.

[73] Assignee: VSL International AG, Lyssach, Switzerland

[21] Appl. No.: 183,526

[22] Filed: Jan. 19, 1994

[51] Int. Cl.[6] ..... E04C 5/12

[52] U.S. Cl. ..... 52/223.13; 52/223.14; 405/259.1; 405/259.4

[58] Field of Search ..... 52/223.1, 223.13, 52/223.14; 29/452; 405/259.1, 259.4, 262

[56] References Cited

U.S. PATENT DOCUMENTS

| | | | |
|---|---|---|---|
| 4,192,215 | 3/1980 | Hymans . | |
| 4,449,855 | 5/1984 | Langwadt | 52/223.13 X |
| 4,558,547 | 12/1985 | Nieto | 52/223.13 |
| 4,819,393 | 4/1989 | Augoyard | 52/223.13 |
| 5,345,742 | 9/1994 | Rogowsky et al. | 52/698 |

FOREIGN PATENT DOCUMENTS

| | | | |
|---|---|---|---|
| 563006A1 | 9/1993 | European Pat. Off. . | |
| 2077729 | 2/1970 | France . | |
| 2122302 | 1/1971 | France . | |
| 2203002 | 10/1973 | France . | |
| 2541339 | 8/1984 | France | 52/223.13 |
| 2652110 | 9/1990 | France . | |
| 3801451 | 8/1989 | Germany | 52/223.13 |
| 1207553 | 8/1989 | Japan | 52/223.13 |
| 775744 | 9/1955 | United Kingdom . | |
| WO93/11324 | 6/1993 | WIPO . | |

OTHER PUBLICATIONS

"VSL Composite System", published in Jun. 1992 by VSL Corporation.

"VSL News: Special Edition–Symposium 1992", Issue Two, published in Sep. 1992 by VSL Corporation.

*Primary Examiner*—Carl D. Friedman
*Assistant Examiner*—Kevin D. Wilkens
*Attorney, Agent, or Firm*—Fliesler, Dubb, Meyer & Lovejoy

[57] ABSTRACT

An anchor head assembly comprising a main body member with a plurality of cavities having the shape of a frustum of a cone in an exterior section and a corresponding number of cavities which may also have the shape of a frustum of a cone in an interior section. The cavities are orientated such that the narrow ends of those in the exterior section are of a different diameter than and face the narrow ends of those in the interior section. The interior section is dome-shaped so as to facilitate the fabrication of the cavities therein and to facilitate the splaying of strands or tendons as they are passed into and through the cavities in both the interior and exterior sections. The dome-shaped section also facilitates self-centering of the anchor head assembly in a bearing plate. Wedge members are used for capturing the strands and tendons in the cavities in the exterior section of the anchor head assembly. A hexagonally shaped exterior section and the dome-shaped interior section also provides for a lighter weight anchor head than has been heretofore available and the strength of the anchor head is improved using austempered cast iron fabrication techniques.

24 Claims, 2 Drawing Sheets

POST-TENSIONING ANCHOR HEAD ASSEMBLY

BACKGROUND OF THE INVENTION

1. Field of the Invention

The present invention relates, in general, to multistrand post-tensioning cable systems for use in fabricating a wide variety of concrete structures, such as bridges, parking garages, buildings and the like and in particular to a novel multistrand anchor head assembly for use in such systems.

2. Description of the Related Art

A typical multistrand post-tensioning cable system used in the fabrication of various concrete structures, such as those described above, comprises a bearing plate and an anchor head. The bearing plate comprises either a rectangular or a cylindrical member having a rear or bearing surface for bearing against a concrete structure. The bearing plate has a bore centrally located therein having an interior end and an exterior end. The interior end of the bore is provided for receiving a plurality of strands or tendons captured in and extending from corresponding strand or tendon anchoring apparatus in a remote concrete structure. The exterior end of the bore is provided for receiving an anchor head which is provided with means for capturing the ends of the strands or tendons received in the interior end of the bore.

The typical anchor head comprises either a rectangular or a cylindrical member having a rear or bearing surface which is inserted in and/or bears against the bearing plate. It is provided with a plurality of strand or tendon receiving cavities for receiving and capturing, with the help of wedge-shaped members, a corresponding number of strands or tendons.

The conventional anchor head typically is made from a relatively massive and heavy casting or forging of ductile iron or mild steel sufficient to withstand the tremendous compressive forces imparted to it via the strands or tendons captured therein. Its front and rear surfaces are generally planar and no attempt has been made heretofore to remove excessive material therefrom or to provide any sort of self-centering capability.

A typical strand receiving cavity in the conventional anchor head comprises a first or interior cylindrical cavity and a second or exterior cavity having the shape of a frustum of a cone in which a strand, after passing through the first cavity, is captured using two or more wedge-shape members.

In addition to the weight and massiveness of the prior known anchor head and the lack of any self-centering features therein, a further disadvantage of the prior known anchor head is that the bundle of strands in the cable captured therein must be splayed at the anchor head and that the cylindrical shape of the first cavity in the conventional anchor head tends to impart bending moments to the strands which increase in magnitude as a function of the distance a strand is from the center of the bundle. These bending moments are found to impart an undesirably large amount of stress and fatigue to the strands in the bundle, particularly in the outermost strands therein.

SUMMARY OF THE INVENTION

In view of the foregoing there is provided in accordance with the present invention a post-tensioning multistrand anchor head assembly comprising a polygonal-shaped exterior front surface for reducing the weight of the assembly, a plurality of exterior strand receiving cavities having the shape of a frustum of a cone and wedges for capturing a plurality of strands therein, a plurality of interior strand receiving cavities having the shape of a frustum of a cone for reducing strand stress and fatigue and a dome-shaped interior rear surface for further reducing the weight of the assembly, facilitating the fabrication of the interior strand receiving cavities and the insertion and self-centering of the anchor head assembly in a bearing plate.

For greater strength than prior known anchor heads, the anchor head of the present invention is made of austempered cast iron.

BRIEF DESCRIPTION OF THE DRAWINGS

The above and other objects, features and advantages of the present invention will become apparent from the following detailed description of the accompanying drawings, in which.

DESCRIPTION OF THE PREFERRED EMBODIMENTS

Figure 1:
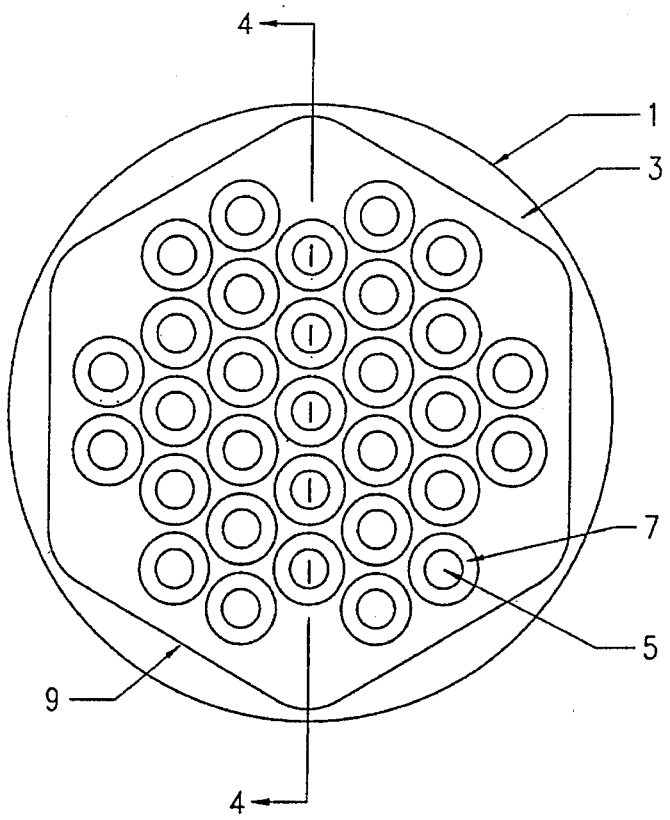
FIG. 1 is a plan view of the exterior surface of an anchor head according to the present invention.
Figure 2:
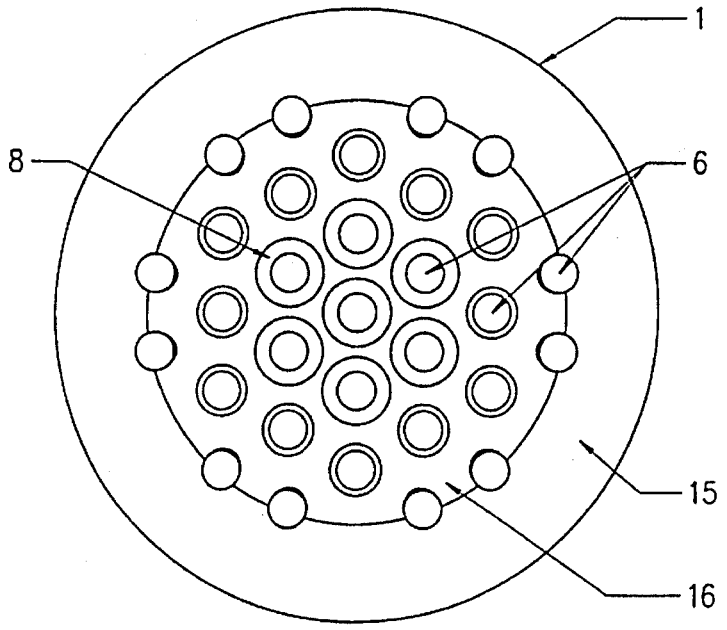
FIG. 2 is a plane view of the interior surface of the anchor head of FIG. 1.
Figure 3:
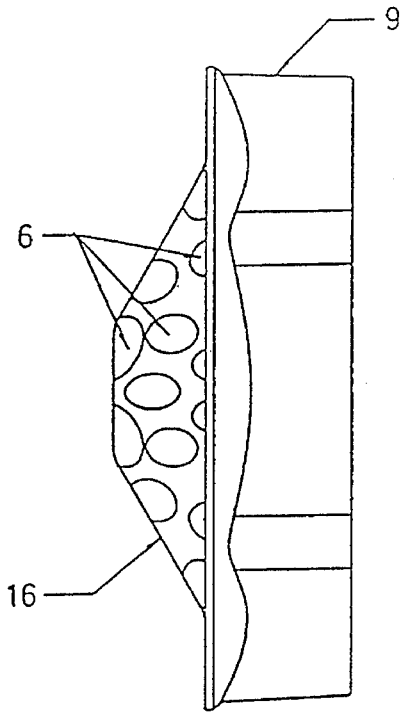
FIG. 3 is a side elevation view of FIG. 1.

Referring to FIGS. 1–6, there is provided in accordance with the present invention a multistrand anchor head assembly designated generally as 1. In the assembly 1 there is provided a main body member designated generally as 2 comprising an exterior section 3 and an interior section 4. The exterior section 3 comprises a plurality of cavities 5 having the shape of a frustum of a cone and the interior section 4 comprises an equal number of corresponding cavities 6. Cavities 6 preferably have the shape of a frustum of a cone but may comprise a cylindrical shape or the like. The narrow ends of the cavities 5 and 6, when the cavities 6 have the shape of a frustum of a cone, are located in the interior of the exterior and interior sections 3 and 4 in communication with and facing each other. The walls 7 and 8 of the cavities 5 and 6 in the exterior and interior sections 3 and 4 of the assembly 1 diverge at a predetermined angle $\phi 1$ relative to a longitudinal axis extending through the center thereof of approximately 7 degrees. As will be described below, this angle facilitates the capturing of a tendon 10 therein and provides for reduced stress and fatigue on the tendon.

In addition to the cavities 5, the exterior section 3 comprises a polygonal-shaped member 9 resulting from the elimination of excessive material from the edges thereof so as to produce an anchor head much lighter in weight than prior known anchor heads without any sacrifice in strength. In the embodiment shown, the member 9 is hexagonal-shaped.

In addition to the cavities 6, as described above, the interior section 4 comprises an annular planar surface 15 in the center of which is located a dome-shaped surface 16 the sides of which slope from the top surface of the dome-shaped surface 16 towards the annular surface 15 at a predetermined angle $\phi 2$ of approximately 30 degrees. The dome-shaped surface 16 further reduces the weight of the anchor head while providing the necessary strength to withstand the large bending moments imparted to the anchor head. In a preferred embodiment of the present invention, the surface 16 has the shape of a frustum of a cone. Extending about the periphery of the planar surface 15 there is provided a shoulder 17. The shoulder 17 comprises a wall 18 which slopes inwardly to the exterior section 3 at a predetermined angle $\phi 3$ of approximately 45 degrees, as shown more clearly in FIG. 5.

Figure 6:
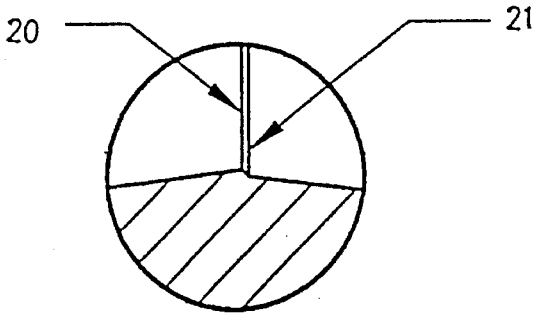
FIG. 6 is an enlarged view taken within the lines 6—6 of FIG. 4.

Between the exterior section 3 and the interior section 4, there is provided a center section designated generally as 20, as shown more clearly in FIG. 6. The center section 20 comprises a plurality of cavities 21 having the shape of a frustum of a cone corresponding in number to the cavities 5 and 6 in the exterior section 3 and interior section 4. Each of the cavities 21 provide an interface between the cavities 5 and 6 with the narrow end of the cavity 21 facing the cavity 5 in the exterior section 3 and the wider end of the cavity 21 facing the cavity 6 in the interior section 4.

Figure 4:
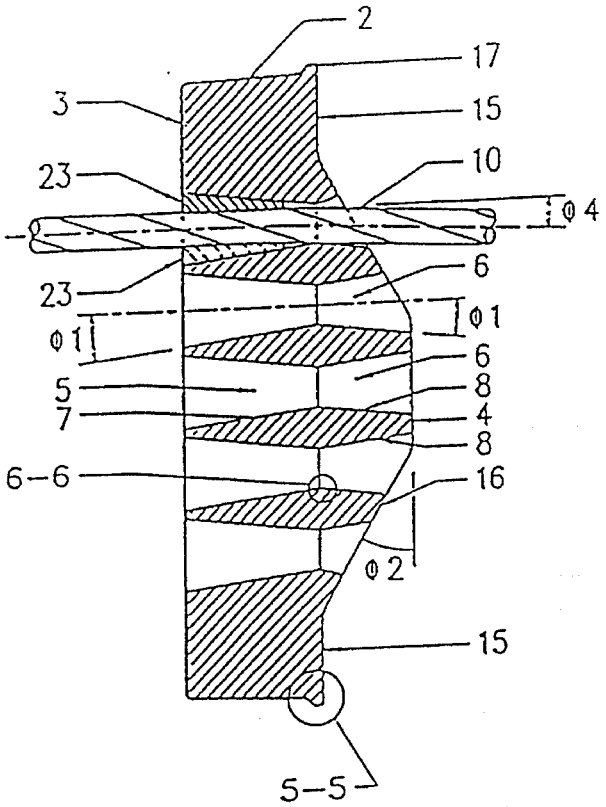
FIG. 4 is a cross-sectional view taken in the direction of lines 4—4 of FIG. 1.
Figure 5:
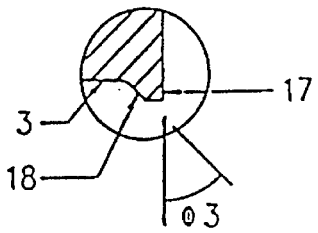
FIG. 5 is an enlarged view taken within the lines 5—5 of FIG. 4.

In use, the strands or tendons in a bundle of strands or tendons captured in and extending from a corresponding strand or tendon anchoring apparatus in a remote concrete structure are splayed adjacent to the interior surface 4 of the anchor head assembly 1 in such a manner as to facilitate the passing of individual strands or tendons through the cavities 6 and 5 of the assembly 1, as shown with respect to the tendon 10 in FIG. 4. In practice, the angle $\phi 4$ at which the outermost strands or tendons enter the anchor head assembly 1 is approximately 3 degrees relative to a longitudinal axis extending parallel to the centerline of the cavities 5 and 6. This angle greatly reduces the stress and fatigue heretofore encountered in prior known conventional anchor heads. As the tendon 10 passes through the cavity 6 and thereafter the cavity 5 and tension is placed on the tendon 10 as by means of a hydraulic jack (not shown), wedge members 23 are placed in the cavity 5 so as to capture the tendon 10 as the tension produced by the hydraulic jack is released.

In addition to facilitating the fabrication of the cavities 6 in the interior section 3 of the assembly 1 and providing the strength to withstand the bending moments imparted to the anchor head, the dome-shaped surface 16 serves as a means for self-centering the anchor head in a bearing plate, as described above.

To provide greater strength than heretofore available in prior known anchor head assemblies, the anchor head assembly of the present invention is fabricated using austempered cast iron processing techniques. It will be appreciated that the physical size, i.e. diameter, and thickness of the anchor head assembly according to the present invention depends on the number of strands or tendons to be captured therein and the loads expected to be carried thereby. However, in any event, due to the use of austempered cast iron and the dome-shaped structure of the anchor head according to the present invention, greater forces are generally handled with no increase in size or weight of the anchor head assembly.

While preferred embodiments of the present invention are described above, it is contemplated that numerous modifications may be made thereto for particular applications without departing from the spirit and scope of the present invention. Accordingly, it is intended that the embodiments described be considered only as illustrative of the present invention and that the scope thereof should not be limited thereto but be determined by reference to the claims hereinafter provided.

What is claimed is:

1. An anchor head assembly comprising:

a main body member having an exterior section with a plurality of cavities having the shape of a frustum of a cone and an interior section with an equal number of corresponding cavities having the shape of a frustum of a cone wherein the narrow ends of corresponding ones of each of said cavities in said exterior and interior sections are of different diameters and are located in the interior of said exterior and interior sections in communication with and facing each other; and means in each of said plurality of cavities in said exterior section for capturing a strand or tendon after said strand or tendon has been passed through a corresponding one of said cavities in said interior section.

2. An anchor head assembly according to claim 1 wherein said interior section comprises an annular planar surface in the center of which is located a truncated dome-shaped surface having side surfaces and a top surface.

3. An anchor head assembly according to claim 2 wherein said side surfaces of said truncated dome-shaped surface slopes downwardly from said top surface of said truncated dome-shaped surface towards said annular planar surface at a predetermined angle $\phi 2$.

4. An anchor head assembly according to claim 3 wherein said predetermined angle $\phi 2$ is approximately 30 degrees.

5. An anchor head assembly according to claim 2 wherein said annular planar surface comprises a shoulder having a bottom wall which slopes inwardly from an edge of said shoulder toward said interior section at a predetermined angle $\phi 3$.

6. An anchor head assembly according to claim 5 wherein said predetermined angle $\phi 3$ comprises approximately 45 degrees.

7. An anchor head assembly according to claim 1 wherein the walls of said cavities in said interior and exterior sections diverge at a predetermined angle $\phi 1$ relative to a longitudinal axis extending through the center thereof.

8. An anchor head assembly according to claim 7 wherein said predetermined angle $\phi 1$ is approximately 7 degrees.

9. An anchor head assembly according to claim 1 comprising a center section between said interior and exterior sections in which there is located a cavity having the shape of a frustum of a cone between and in communication with corresponding ones of said cavities in each of said interior and exterior sections.

10. An anchor head assembly according to claim 9 wherein the narrow end and the wide end of each of said cavities in said center section faces a corresponding cavity in said exterior and interior sections, respectively.

11. An anchor head assembly according to claim 1 wherein said exterior section comprises an exterior hexagonal section.

12. An anchor head assembly comprising:

a main body member having an exterior section with a plurality of cavities having the shape of a frustum of a cone and an interior section having a dome-shaped surface and an equal number of corresponding cavities wherein each cavity has the shape of a frustrum of a cone, corresponding ones of said cavities in said exterior and interior sections being located in communication with each other; and means in each of said plurality of cavities in said exterior section for capturing a strand or tendon after said strand or tendon has been passed through a corresponding one of said cavities in said interior section.

13. An anchor head assembly according to claim 12 wherein said interior section comprises an annular planar surface and said dome-shaped surface is located in the center of said annular planar surface.

14. An anchor head assembly according to claim 13 wherein said dome-shaped surface in the center of said planar surface has a shape of a frustum of a cone where said frustum of said cone has a top surface and side surfaces.

15. An anchor head assembly according to claim 13 wherein said side surfaces of said frustum of a cone slopes from said top surface towards said annular planar surface at a predetermined angle $\phi 2$.

16. An anchor head assembly according to claim 15 wherein said predetermined angle $\phi 2$ is approximately 30 degrees.

17. An anchor head assembly according to claim 13 wherein said annular planar surface comprises a shoulder having a bottom wall which slopes downwardly from an edge of said shoulder to said interior section at a predetermined angle $\phi 3$.

18. An anchor head assembly according to claim 17 wherein said predetermined angle $\phi 3$ comprises approximately 45 degrees.

19. An anchor head assembly according to claim 12 wherein each of said cavities in said interior section has the shape of a frustum of a cone, the narrow ends of which are in communication with and face corresponding cavities in said exterior section.

20. An anchor head assembly according to claim 19 wherein the walls of said cavities in said interior and exterior sections diverge at a predetermined angle $\phi 1$ relative to a longitudinal axis extending through the center thereof.

21. An anchor head assembly according to claim 20 wherein said predetermined angle $\phi 1$ is approximately 7 degrees.

22. An anchor head assembly according to claim 12 comprising a center section between said interior and exterior sections in which there is located a cavity having the shape of a frustum of a cone between and in communication with corresponding ones of said cavities in each of said interior and exterior sections.

23. An anchor head assembly according to claim 22 wherein the narrow end and the wide end of each of said cavities in said center section faces a corresponding cavity in said exterior and interior sections, respectively.

24. An anchor head assembly according to claim 12 wherein said exterior section comprises an exterior hexagonal section.

* * * * *